US008550860B2

(12) United States Patent
Dick et al.

(10) Patent No.: US 8,550,860 B2
(45) Date of Patent: Oct. 8, 2013

(54) ELECTRICAL CONNECTOR HAVING FINGER-ACTUATED RETAINER

(75) Inventors: Bradley M. Dick, Linden, MI (US); Christopher Dillon, Springfield Township, MI (US); Matt Bailey, Redford, MI (US); Scott Marceau, Grand Blanc, MI (US)

(73) Assignee: Molex Incorporated, Lisle, IL (US)

( * ) Notice: Subject to any disclaimer, the term of this patent is extended or adjusted under 35 U.S.C. 154(b) by 187 days.

(21) Appl. No.: 13/056,039

(22) PCT Filed: Jul. 27, 2009

(86) PCT No.: PCT/US2009/051836

§ 371 (c)(1), (2), (4) Date: May 9, 2011

(87) PCT Pub. No.: WO2010/014540

PCT Pub. Date: Feb. 4, 2010

(65) Prior Publication Data

US 2011/0207357 A1 Aug. 25, 2011

Related U.S. Application Data

(60) Provisional application No. 61/083,923, filed on Jul. 26, 2008.

(51) Int. Cl.
*H01R 13/514* (2006.01)

(52) U.S. Cl.
USPC ..... 439/752; 439/595

(58) Field of Classification Search
USPC ..... 439/752, 595
See application file for complete search history.

(56) References Cited

U.S. PATENT DOCUMENTS

| | | | | |
|---|---|---|---|---|
| 5,059,142 | A | 10/1991 | Ohta et al. | |
| 5,569,055 | A * | 10/1996 | Yamanashi et al. | 439/752 |
| 5,575,692 | A * | 11/1996 | Cecil et al. | 439/752 |
| 5,611,712 | A * | 3/1997 | Morishita et al. | 439/752 |
| 6,106,340 | A * | 8/2000 | Myer et al. | 439/752 |
| 7,066,773 | B1 | 6/2006 | Martin | |
| 2007/0218780 | A1 | 9/2007 | Onoda et al. | |

FOREIGN PATENT DOCUMENTS

| | | |
|---|---|---|
| DE | 195 38 613 A1 | 5/1996 |
| EP | 1 271 705 A1 | 1/2003 |
| FR | 2 684 242 A1 | 5/1993 |
| GB | 2 262 664 A | 6/1993 |

* cited by examiner

*Primary Examiner* — Truc Nguyen
(74) *Attorney, Agent, or Firm* — Larry I. Golden; Clarence R. Moon, III

(57) ABSTRACT

The present disclosure is directed to TPA connectors. The TPA connectors of the present disclosure can have a connector body that can include a plurality of cavities for receiving terminals. The TPA connectors can also include a retainer for locking the terminals in their seated position and for locking to the connector body to prevent unwanted removal thereof. The connector body can include posts with stop surfaces which can prevent the retainer from moving from a pre-lock position to a fully locked position by engaging contact surfaces on the locking arms of the retainer. The locking arms can be cantilevered and have outwardly directed projections to engage the posts for locking the retainer to the connector body. The locking arms can be deflected inwardly with a squeezing or pinching motion to disengage the contact surfaces from the stop surfaces of the posts and permitting the retainer to move to the fully locked position by pushing retainer towards the connector body. Once the projects pass the post, locking arms can be release to allow the projections to engage the posts to lock the retainer to the connector body.

12 Claims, 7 Drawing Sheets

ELECTRICAL CONNECTOR HAVING FINGER-ACTUATED RETAINER

This application claims the benefit of U.S. Provisional Application Ser. No. 61/083,923 filed on Jul. 26, 2008, the entirety of which is incorporated herein by reference.

BACKGROUND

The present disclosure is generally directed to electrical connectors. More particularly, the connectors disclosed herein have terminal position assurance (TPA) elements. Specifically, the present disclosure is directed to TPA connectors having a finger-actuated retainer.

TPA connectors have been developed primarily to ensure the proper seating of terminals installed within the cavities of the connector housing usually by the end user. Improper seating of a terminal in the cavity may occur if the terminal is not fully inserted into the housing during the assembly of the connector. Typically, TPA connectors allow one to determine whether the inserted terminal has been properly seated. TPA connectors also secure these terminals in a position for mating with the contacts of a complementary connector or other electrical device. Also, TPA connectors can be locked to maintain the integrity of the terminal connections against vibrations and other jarring motions. Accordingly, TPA connectors have found considerable use in the automotive industry.

TPA connectors typically include a connector body having cavities for accepting terminals, and a retainer. Such TPA connectors usually are provided to end users with the retainer joined with the connector body as a single unit but with the retainer not fully locked to the connector body. In other words the. TPA connector is provided in a pre-lock state. The end user can then insert the individual terminals into the respective cavities of the connector body. Each cavity of the connector body can have a latching arm which is deflected by the terminal as it passes into the cavity. Once the terminal is fully inserted, the resilient latching arm rebounds back to its initial position and latches behind a shoulder or other terminal surface to secure the terminal in the cavity.

After all the terminals have been inserted into their respective cavities, the retainer can be pressed into a fully locking position. The retainer has finger members sized to fit behind the latching arms to prevent the latching arms from being deflected out of the latched position against the terminal. The retainer can also have deflectable locking arms for engaging posts on the connector body to lock the retainer to the connector body when the retainer is moved to the fully locked position.

Generally, once the retainer is fully locked to the connector body, a tool is required to move the retainer back to the pre-lock state. While this is advantageous to prevent accidental disengagement, it presents difficulties, such as creating delays in the assembly process, when the retainer is accidentally or inadvertently moved to the fully locked state prior to insertion of the terminals. Inadvertent locking of the retainer is known to happen on occasion during transport of the TPA connectors.

In order to minimize or prevent inadvertent locking of the retainer to the connector body, TPA connectors have been provided with levered locking arms which abut stop members to impede the retainer from moving to the fully locked position. In order to fully lock the retainer, the user must actively press one end of the levered locking arms to pivot the opposite ends outward. This disengages the locking arms from the stop member and allows the retainer to move to the fully locked position.

Such TPA connectors with levered locking arms, however, result in the ends of the arms pivoting outward from the connector body which increase the space requirement for the TPA connector. In addition, outwardly pivoting locking arms are prone to snagging nearby wires or other objects.

Accordingly, the present disclosure provides TPA connectors which resist inadvertent locking of the retainer and have a compact package. TPA connectors disclosed herein can require a large force to inadvertently move the retainer to a fully locked position while affording minimal effort to purposefully move the retainer to a fully locked position. Also, the locking arms of the present TPA connectors also resist snagging that can otherwise occur with TPA connectors having outwardly pivoting locking arms. Furthermore, TPA connectors according to the present disclosure can resist dismounting or separation of the retainer from the connector body.

SUMMARY

In one embodiment according to the present disclosure, a connector is provided comprising a connector body and a retainer. The connector body has a connector mating end, a terminal entry end, a first lateral wall at one side of the connector body and a second lateral wall at an opposite side of the connector body, at least one cavity extending from the terminal entry end to the connector mating end for receiving a terminal and at least one post adjacent the terminal entry end and at one side of the connector body. The first and second lateral walls extend between the connector mating and terminal entry end, and the at least one post is spaced apart from the first lateral wall and has a stop surface. The retainer, which is mountable to the connector body for moving from a pre-lock position allowing insertion and removal of the terminal to a fully locked position for locking the terminal in the at least one cavity, has a face plate having one lateral side and an opposite lateral side, at least one cantilever locking arm extending in a locking direction from one lateral side of the face plate and has a projection extending from an outer surface thereof for engaging the at least one post to lock the retainer to the connector body. The at least one cantilever locking arm has a contact surface for engaging the stop surface of the at least one post wherein engagement of the contact surface with the stop surface restricts movement of the retainer from the pre-lock position to the fully locked position and wherein inward deflection of the at least one locking arm disengages the contact and stop surfaces to permit movement of the retainer to the fully locked position.

DETAILED DESCRIPTION

It is to be understood that the disclosed embodiment(s) are merely exemplary of the disclosure, which may be embodied in various forms. Therefore, specific details disclosed herein are not to be interpreted as limiting, but merely as a representative basis for teaching one skilled in the art to variously employ the inventive features herein disclosed in virtually any appropriate manner and combination.

Figure 1:
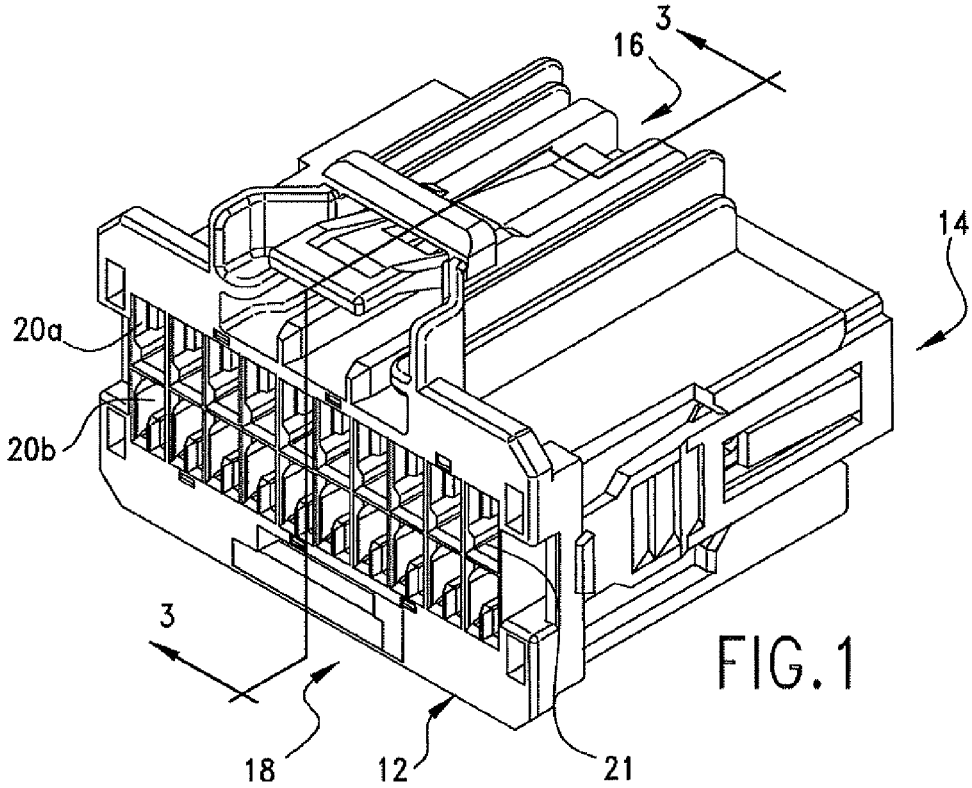
FIG. 1 shows a perspective view of one embodiment of a TPA connector according to the present disclosure.
Figure 2:
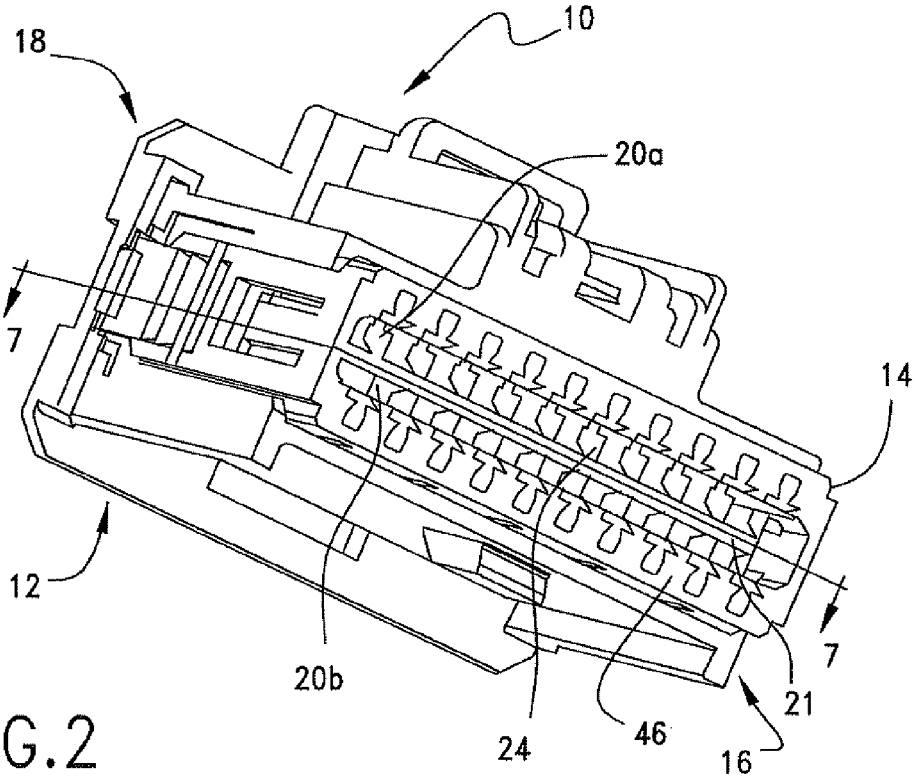
FIG. 2 shows a perspective view of the opposite end of the connector shown in FIG. 1.

FIGS. 1 and 2 show one embodiment of the TPA connector 10. Connector 10 can be a female connector for mating with a complementary connector (not shown) and can have a connector body 12 and a retainer 14 connected to the body. Body 12 and retainer 14 can be made of a rigid plastic such as PBT to provide dielectric properties. Retainer 14 can be attached to body 12 at mating end 16 and opposite mating end 16 can be terminal entry end 18.

Figure 3:
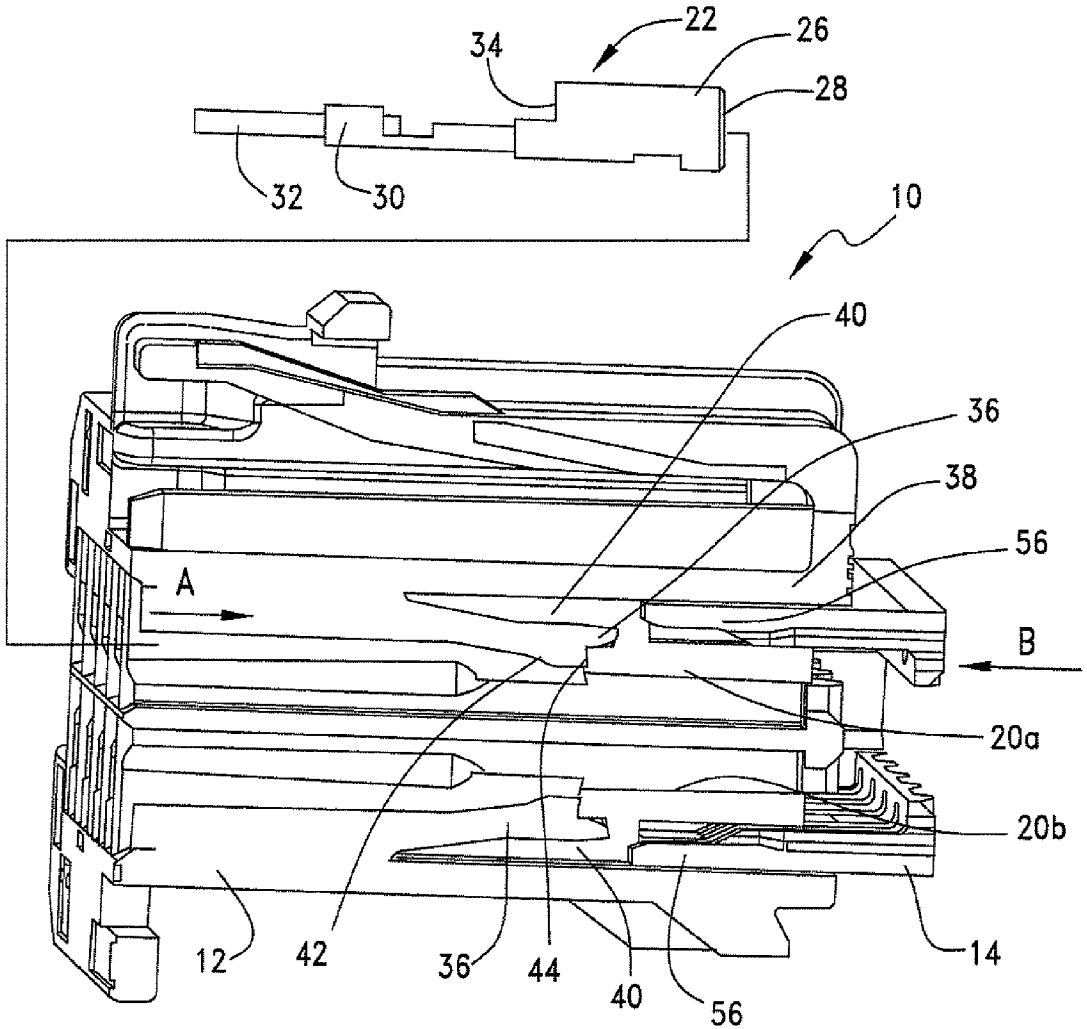
FIG. 3 shows a cross-sectional view taken at line 3-3 of the connector shown in FIG. 1 and one embodiment of a terminal.

Connector body 12 can have an upper row of cavities 20*a* aligned with a lower row of cavities 20*b* for receiving female terminals 22 (shown in FIG. 3). The cavities 20*a*, 20*b* can extend through connector body 12 from the mating end 16 to the terminal entry end 18. Separating the rows of cavities 20*a*, 20*b* can be central wall 21. Retainer 14 can have a central opening 24 to allow the contacts of a complementary connector to be inserted into cavities 20*a*, 20*b* to make an electrical connection with terminals 22.

Terminals 22 shows in FIG. 3 can have a rectangular housing member 26 with a front opening 28 for receiving the contact of a mating connector (not shown). At the opposite end of opening 28 can be crimpable fittings 30 to mechanically secure and electrically connect the end of wire 32. Other known wire terminating structures could also be used. Housing member 26 can have shoulder 34 for engaging deflectable latching arm 36 positioned in upper cavity 20*a*.

Terminal 22 can be inserted in upper cavity 20*a* in direction A with opening 28 entering first. Latching arm 36 can extend in cavity 20*a* in direction A and can be spaced from wall 38 of the connector body 12 to define deflection space 40. Latching arm 36 can have ramped surface 42 opposite deflection space 40 such that insertion of terminal 22 in cavity 20*a* results in latching arm 36 being deflected towards deflection space 40 to permit terminal 22 to pass through cavity 20*a*. Once housing member 26 of terminal 22 passes engagement surface 44, terminal 22 can be properly seated and latching arm 36 can rebound to its initial position. Engagement surface 44 then blocks terminal 22 from being pulled back out of cavity 20*a* by engaging shoulder 34. It is understood that all of cavities 20*a* and 20*b* have the internal structures just described above except that lower row cavities 20*b* are inverted.

Figure 4:
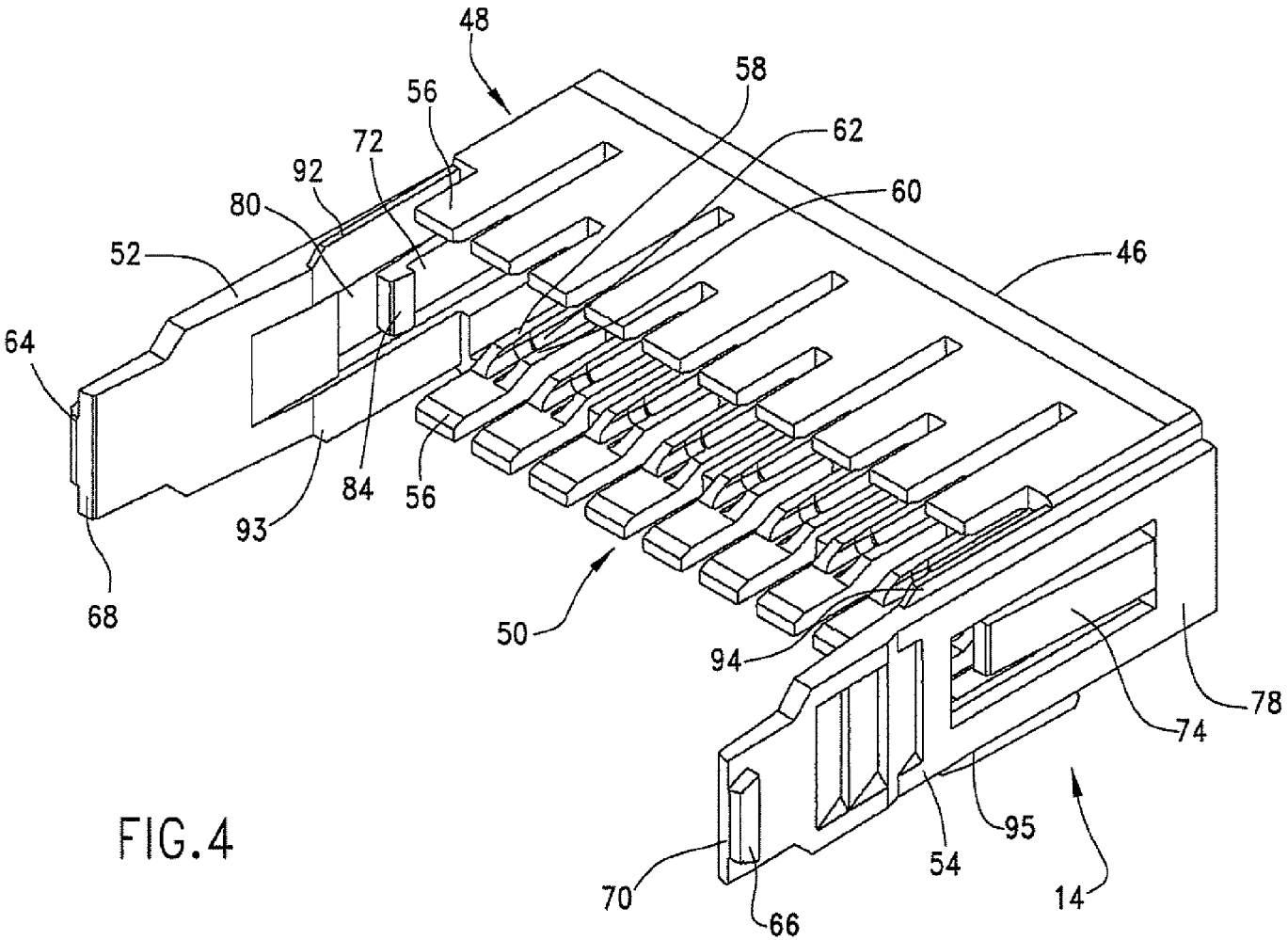
FIG. 4 shows a perspective view of the retainer of the connector shown in FIGS. 1 and 2.

Retainer 14 shown separately in FIG. 4 can have face plate 46 having opening 24 (shown in FIG. 2) for fitting over the openings formed by cavities 20*a*, 20*b* at the mating end 16. Extending in the same direction from face plate 46 can be upper wall 48, lower wall 50 and laterally spaced locking members 52, 54. Upper and lower walls 48, 50 each can have a number of wedging fingers 56 to match the number of cavities 20*a*, 20*b*, respectively. Wedging fingers 56 can be sized and shaped to readily enter cavities 20*a*, 20*b* and deflection spaces 40. Each wedging finger 56 can have a pair of bracketing walls 58, 60 that define guide groove 62 to align and guide the contacts of a complementary mating connector into openings 28 of terminals 22 residing in cavities 20*a*, 20*b*. Bracketing walls 58, 60 extend toward the interior of retainer 14 in a direction perpendicular to the direction wedging fingers 56 extend from face plate 46.

As shown in FIG. 3, retainer 14 is mounted to connector body 12 and is positioned in a pre-lock state. In the pre-lock position, wedging fingers 56 are retracted from deflection spaces 40. As retainer 14 moves in locking direction B, wedging fingers 56 enter deflection spaces 40. With wedging fingers 56 in deflection spaces 40, movement of latching arms 36 into deflection spaces 40 can be prevented and also serve to lock terminals 22 within cavities 20*a*, 20*b*. As a result, terminals 22 are secured in position for mating with contacts of a complementary mating connector and an additional lock or measure of security is provided against removal of terminals 22. In addition, should terminal 22 not be properly seated in cavity 20*a*, latching arm 36 would likely still be deflected in deflection space 40 which could impede wedging finger 56 from entering. This would serve to notify the end user of an improperly seated terminal 22.

Retainer 14 and connector body 12 can have cooperating structures to fully lock retainer 14 to connector body 12 and permit unlocking or disengagement from the fully locked position to the pre-lock position. In addition, cooperating structures can be provided on retainer 14 and connector body 12 to prevent retainer 14 from complete separation from connector body 12 from the pre-lock position shown in FIG. 3.

As shown in FIG. 4 locking arms 52, 54 can be cantilevered for pivoting towards each other. Projections 64, 66 can be formed on the outside surface of locking arms 52, 54 respectively and adjacent the ends thereof for fully locking retainer 14 to connector body 12 as will be described in more detail below. Projections 64, 66 can be positioned centrally along the width of and have a thickness similar to the thickness of the respective locking arm 64, 66. The ends of locking arms 52, 54 can include contact surfaces 68, 70. Contact surfaces 68, 70 can be tapered or angled to prevent inadvertently fully locking retainer 14 to connector body 12 as will be described in more detail below. As shown more clearly in FIG. 5, contact surfaces 68, 70 can extend at an angle both inward towards the interior and towards the face plate 46 of retainer 14 such that movement of retainer 14 towards connector body (locking direction) tends to urge locking arms outwardly away from connector body 12 as opposed to inwardly which could result in locking arms lockingly engaging connector body as discuss in more detail below. The angle of contact surfaces 68, 70 relative to axis C, which is parallel to the direction locking arms 52, 54 extend from face plate 46, can be from about 95 to about 115 degrees.

Figure 5:
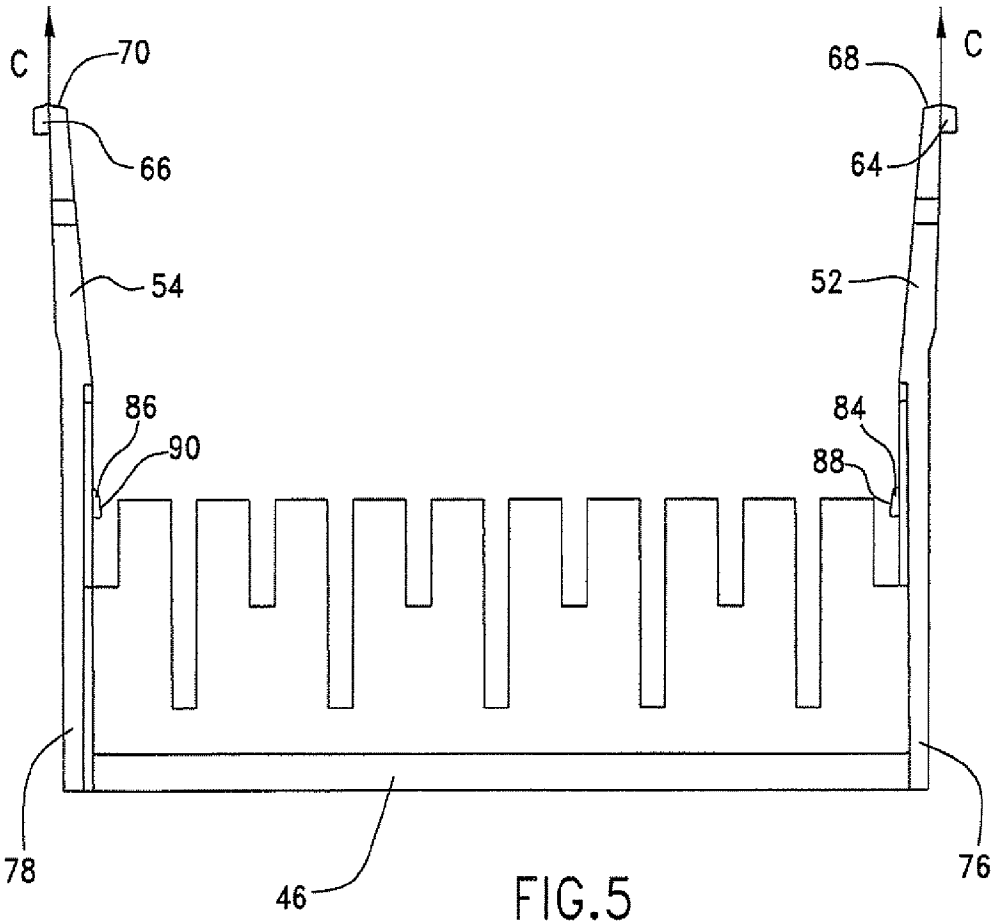
FIG. 5 shows an elevation view of a top end of the retainer shown in FIG. 4.

Retainer 14 can also include spring arms 72, 74 for preventing the dismounting or separation of retainer 14 from connector body 12 as will be describe in more detail below. Spring arms 72, 74 can be formed from base 76, 78 of locking arms 52, 54, respectively. Each base 76, 78 can have a cutout region 80, 82 into which springs arms 72, 74 extend. Spring arms 72, 74 can be cantilevered to pivot toward and away from each other and can have bulged ends 84, 86 extending towards the interior of retainer 14. Surfaces 88, 90 of bulged ends 84, 86 can be beveled to rise in a direction towards face plate 46 as shown in FIGS. 4 and 5. Each locking arm 52, 54 can also include aligning wings 92, 94 on the upper surfaces of locking arms 52, 54, respectively for maintaining alignment of retainer 14 as it is mounted to connector body 12. Wings 93, 95 can also be provided on the lower surfaces opposite wings 92, 94.

Figure 6:
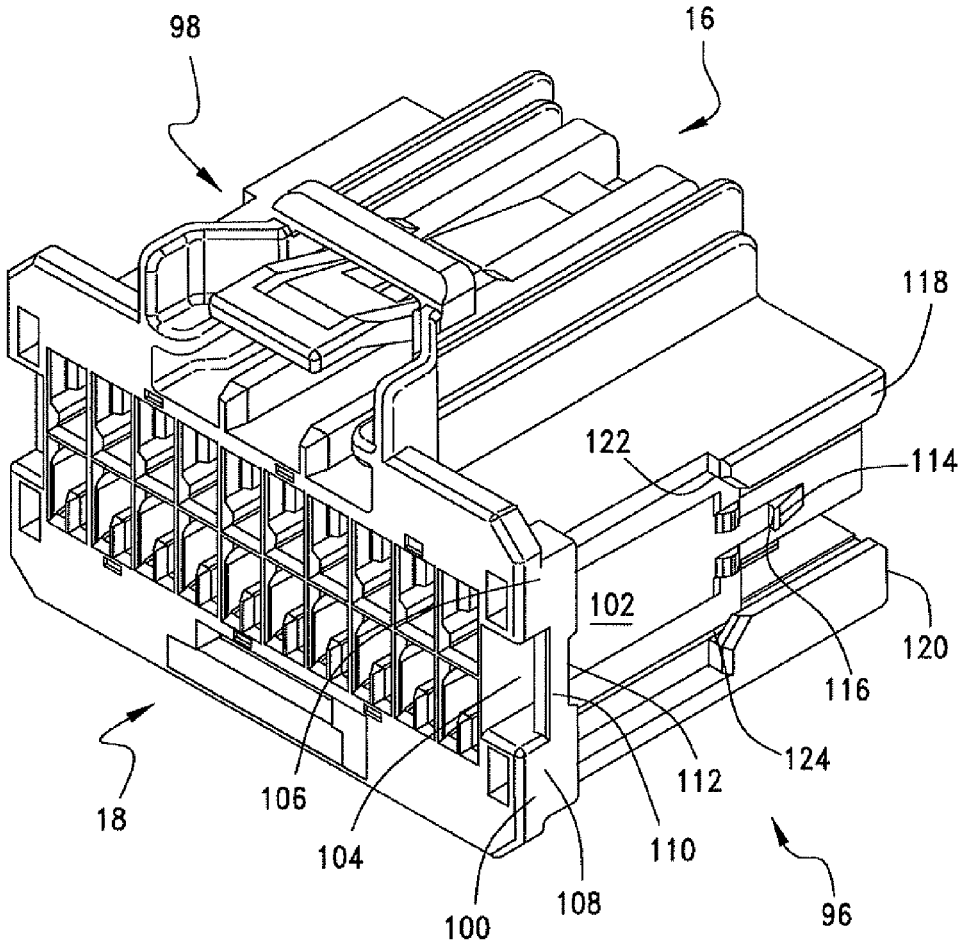
FIG. 6 shows a perspective view of the connector body of the connector shown in FIGS. 1 and 2.

Moving to FIG. 6, connector body 12 is shown. In describing connector body 12, reference will be made to only one lateral side 96 of connector body 12 with the understanding that such description applies equally to the opposite lateral side 98. Also, structures not visible in FIG. 6 but shown in other drawing figures of this disclosure will be given the reference numeral of its corresponding structure and designated with a prime (').At terminal end 18, connector body 12 can have harness 100. Harness 100 extends beyond lateral wall 102. Extending between upper and lower shoulders 106, 108 can be post 110 which also can be spaced from lateral wall 102 to define gap 104. Post 110 can have stop surface 112 facing in the direction of mating end 16 to engage contact surface 70 of locking arm 54 and thus restrict movement of retainer 14 to the fully locked position. Stop surface 112 can also have a taper or angle complementary to or the reverse of contact surfaces 68, 70.

Lateral wall 102 can have ramp 114 adjacent mating end 16 and have engagement face 116 for engaging bulging end 86 of spring arm 74 to prevent the dismounting of retainer 14 from connector body. Ramp 114 can rise from lateral wall 102 as it extends toward terminal end 18. Also, adjacent mating end 16 can be upper and lower brackets 118, 120 extending laterally beyond lateral wall 102 to define upper and lower channels 122, 124 for receiving wings 94, 95 and to assist in mounting retainer 14 to connector body 12.

Figure 7:
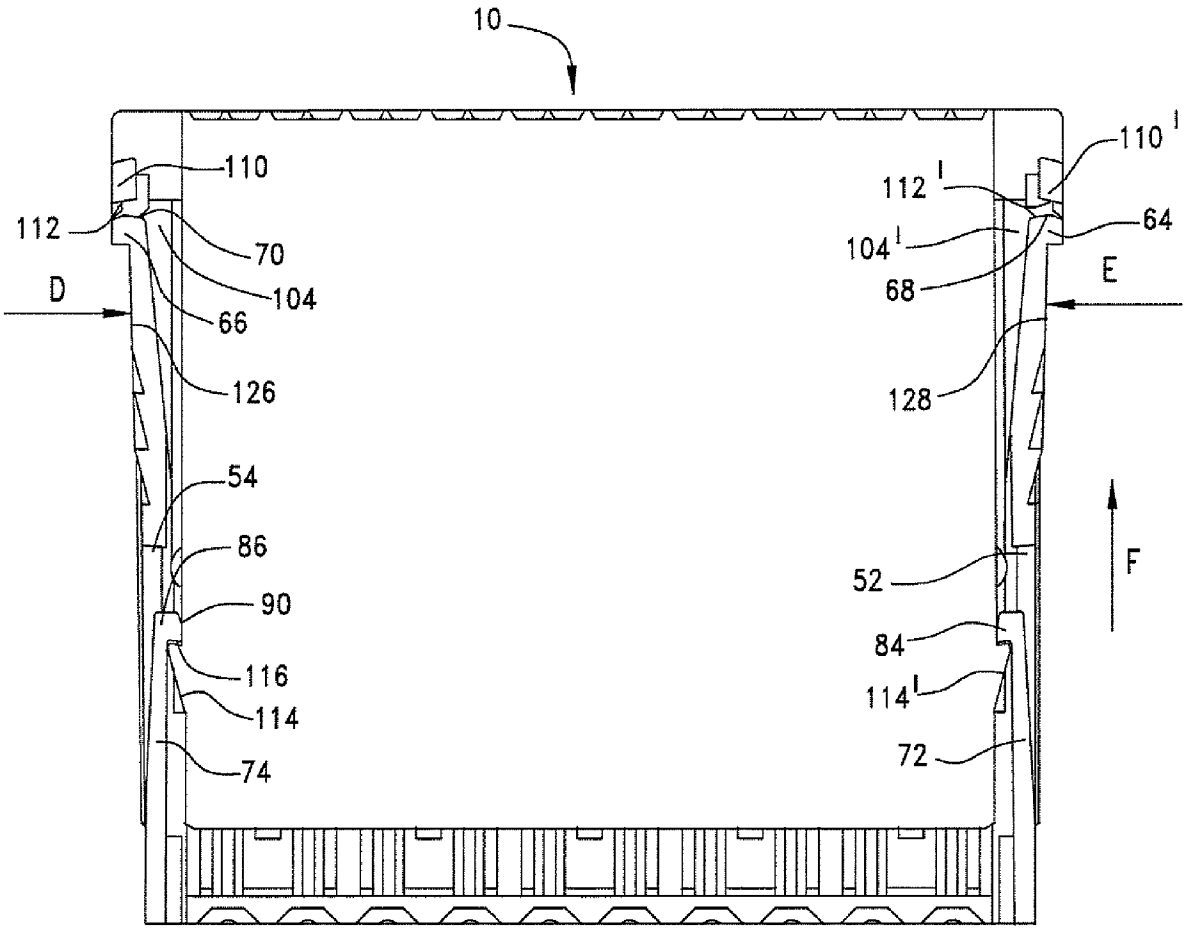
FIG. 7 shows a cross-sectional view taken at line 7-7 shown in FIG. 2.

When mounting retainer 14 to connector body 12, retainer 14 and connector body 12 are positioned such that face plate 46 of retainer 14 and terminal end 18 of connector body 12 are facing in opposite directions, Retainer 14 and connector body 12 are brought together and wings 92, 93 and 94, 95 can be passed through channels 120, 122. Wings 92, 93 also can be passed through channels duplicated on opposite lateral side 98. With continued movement of retainer 14 and connector body 12 towards each other as shown in FIG. 7 spring arm 74 can be pivoted away from connector body 12 as surface 90 of bulged end 86 engage each other. Once bulging end 86 clears ramp 114, spring arm 74 rebounds back towards connector body 12, movement in the opposite or dismounting direction is resisted by engagement of engagement face 116 and budging end 86. The same occurs at the opposite lateral end with spring arm 72. Retainer 14 and connector body 12 are now in the pre-lock state or position as shown in FIG. 7. It is understood that locking arms 52, 54, spring arms 72, 74 and wedging fingers 56 are positioned and/or sized relative to each other such that wedging fingers 56 do not enter deflection space 40 when spring arms 72, 74 engage ramps 114, 114' and contact surfaces 68, 70 engage or are just shy of engagement with stop surfaces 112', 112 in the pre-lock position.

Figure 8:
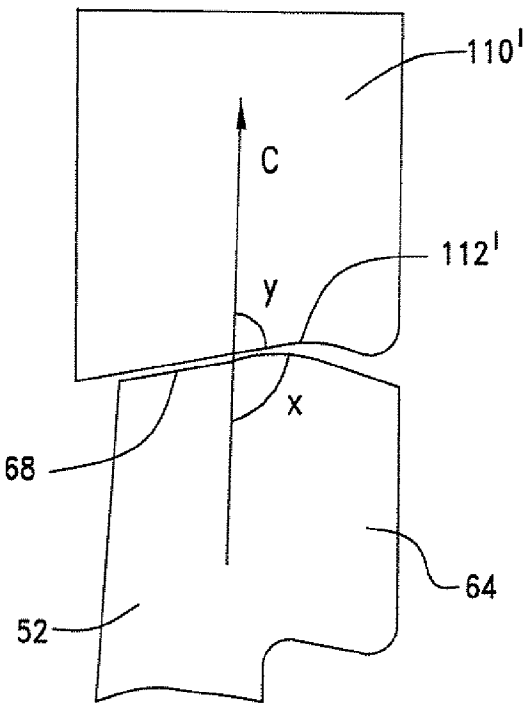
FIG. 8 shows the interaction of the locking arm and post of the connector shown in FIGS. 1 and 2.

Further movement of retainer 14 and connector body 12 towards each other can occur until angled contact surface 70 of locking arm 54 contacts stop surface 112 of post 110 and angled contact surface 68 of locking arms 52 contacts the stop surface 112' of post 110'. As shown in FIG. 8, the reverse or complementary angles of surfaces 68 and 112', which are also found on surfaces 70 and 112 can resist further movement towards each other and movement of locking arm 52 towards connector body 12. Engagement of surfaces 68, 70 with surfaces 112, 112' can prevent inadvertent movement to the fully locked position since the angle or taper tends to direct locking arms outwardly and away from engagement with posts 110, 110'. The engagement of surfaces 68, 70 with surfaces 112', 112 respectively, can resist from about 150 N to about 200 N of force urging retainer 14 and connector body 12 towards each other, in other words an engagement force.

The amount of force that can be resisted by engagement of surfaces 68, 70 with 112', 112 can vary depending upon the angle at which these surfaces engage. For example, angle X between axis C and surface 68 can be greater than 90 degrees and angle Y between axis C and surface 112' can be less than ninety degrees by an equal amount. These angles can be replicated for surfaces 70 and 112 respectively. As shown in FIG. 8, angle X for surface 68 can be from about 95 to about 115 degrees and angle Y for surface 112' can be from about 85 to about 65 degrees and surfaces 70 and 112 can equally be from about 95 to about 115 degrees and from about 85 to about 65 degrees, respectively. At such angles, retainer 14 can resist an engagement force of from about 150 to about 200 N. It is understood that the angle of contact surfaces 68, 70 and their complementary stop surfaces 112', 112 can be adjusted to vary to some extent the ability to resist a force urging the retainer 14 and connector body 12 towards each other.

Figure 9:
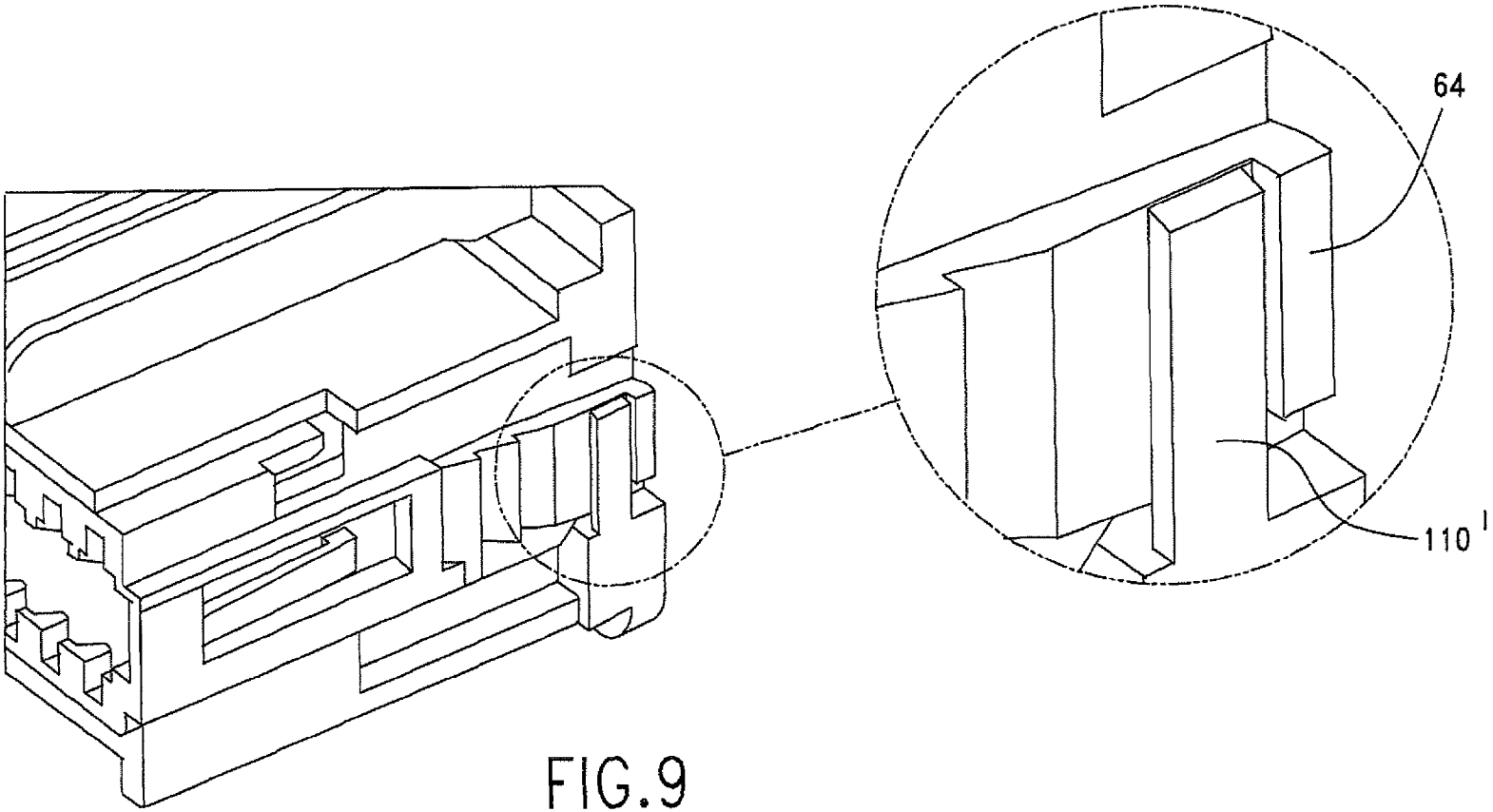
FIG. 9 shows the connector shown in FIGS. 1 and 2 with a cutout section to illustrate the engagement of the locking arm at the post.

To fully lock retainer 14 to connector body 12, locking arms 52, 54 can be pressed inwardly towards connector body or towards each other by a squeezing or pinching motion of a thumb and forefinger at press points 126, 128 as shown by directions D, E, respectively in FIG. 7. Press points 126, 128 can be adjacent projections 66, 64, respectively to reduce the force necessary to pivot locking arms 54, 52 towards each other. The cantilevered locking arms 52, 54 can pivot inwards towards the connector body 12 allowing projections 64, 66 to move out of alignment with posts 110, 110'. Pushing retainer 14 in direction F while pressing locking arms 52, 54 can move locking arms 52, 54 into gaps 104', 104 respectively and projection 64, 64 around posts 110, 110'. After projections 64, 66 clear posts 110', 110, locking arms 52, 54 can be released to allow projections 64, 66 to engage posts 110', 110 and to lock retainer 14 to connector body 12 as shown in FIG. 9. In this locked position, wedging fingers 56 now occupy deflection spaces 40.

To move from the fully locked position to the pre-locked position the steps need to be reversed. That is, locking arms 52, 54 can be pressed together until projections 64, 66 move out of engagement with posts 110' 110 and retainer 14 can then be pulled in a direction opposite direction F. Continued movement in this direction can proceed until bulging ends 84, 86 engage ramps 114, 114'. In order to dismount retainer 14, spring arms 72, 74 can be pivoted out to disengage ramps 114, 114' and bulging ends 84, 86.

It should be understood that various changes and modifications to the embodiments described herein will be apparent to those skilled in the art. Such changes and modifications can be made without departing from the spirit and scope of the present invention and without diminishing its attendant advantages. It is, therefore, intended that such changes and modifications be covered by the appended claims.

The invention claimed is:

1. A connector comprising:

a) a connector body having:

1) a connector mating end;

2) a terminal entry end;

3) a first lateral wall at one side of the connector body and a second lateral wall at an opposite side of the connector body, the first and second lateral walls extending between the connector mating and terminal entry end, the first lateral wall including a ramp having a surface facing the terminal entry end;

4) at least one cavity extending from the terminal entry end to the connector mating end for receiving a terminal; and 5) at least one post adjacent the terminal entry end and at one side of the connector body, the at least one post spaced apart from the first lateral wall and having a stop surface; and b) a retainer mountable to the connector body for moving from a pre-lock position allowing insertion and removal of the terminal to a fully locked position for locking the terminal in the at least one cavity, the retainer having:

1) a face plate having one lateral side and an opposite lateral side;

2) at least one cantilever locking arm extending in a locking direction from one lateral side of the face plate and having a projection extending from an outer surface thereof for engaging the at least one post to lock the retainer to the connector body, the at least one cantilever arm having a contact surface for engaging the stop surface of the at least one post;

wherein engagement of the contact surface with the stop surface restricts movement of the retainer from the pre-lock position to the fully locked position and wherein inward deflection of the at least one locking arm disengages the contact and stop surfaces to permit movement of the retainer to the fully locked position; and 3) at least one spring arm having an inwardly directed catch member for engaging the surface of the ramp when the retainer is in the pre-lock position to restrict dismounting of the retainer from the connector body.

2. The connector of claim 1 wherein the connector body has a second post adjacent the terminal entry end and at the opposite side of the connector body, the second post spaced apart from the second lateral wall and having a stop surface; and the retainer has a second cantilever locking arm extending in a locking direction from an outer surface thereof for engaging the second post to lock the retainer to the connector body, the second cantilever locking arm has a contact surface for engaging the stop surface of the second post.

3. The connector of claim 1 wherein the second lateral wall includes a ramp having a surface facing the terminal entry end and the retainer includes a second spring arm having an inwardly directed catch member for engaging the surface of the ramp when the retainer is in the pre-lock position to restrict dismounting of the retainer from the connector body.

4. The connector of claim 1 wherein the at least one spring arm is integrated with the at least one cantilever locking arm.

5. The connector of claim 3 wherein the second spring arm is integrated with the second locking arm.

6. The connector of claim 1 wherein the at least one cavity includes a resilient latching member for deflecting to permit entry of a terminal and for rebounding to impede removal of the terminal once properly seated.

7. The connector of claim 6 wherein the retainer includes at least one finger extending in a locking direction from the face plate for entry into a deflection space of at least one cavity to prevent the resilient latching members from deflecting.

8. The connector of claim 7 wherein the pre-lock position the at least one finger is retracted from the deflection space and the spring arms engage the ramp surfaces, and in the fully locked positions the fingers are in the deflection space and the projections of the cantilever locking arms engage the posts.

9. The connector of claim 2 wherein each of the stop surfaces and contact surfaces are tapered.

10. The connector of claim 9 wherein the contact surfaces have a taper relative to the axis extending in the locking direction of a predetermined angle greater than 90 degrees and the stop surfaces have a taper relative to the axis of the predetermined angle less than 90 degrees.

11. The connector of claim 9 wherein engagement of the contact surfaces with the stop surfaces withstands a force of from about 150 to about 200 N urging movement of the retainer from the pre-lock position to the fully locked position.

12. The connector of claim 10 wherein the contact surfaces have a taper relative to an axis extending in the locking direction of a from about 95 to about 115 degrees and the stop surfaces have a taper relative to the axis of from about 85 to about 65 degrees.

* * * * *